United States Patent [19]

McDonald

[11] Patent Number: 4,689,926

[45] Date of Patent: Sep. 1, 1987

[54] FOUNDATION FOR BUILDING STRUCTURE AND METHOD OF CONSTRUCTING BUILDING STRUCTURE UTILIZING SAME

[76] Inventor: J. Kevin McDonald, 6452 Briarway Cove, Memphis, Tenn. 38115

[21] Appl. No.: 826,182

[22] Filed: Feb. 5, 1986

[51] Int. Cl.[4] ..... E02D 27/00

[52] U.S. Cl. ..... 52/169.11; 52/169.12; 52/174

[58] Field of Search ..... 52/DIG. 11, 292, 23, 52/169.11, 169.12, 174, DIG. 3

[56] References Cited

U.S. PATENT DOCUMENTS

| | | | |
|---|---|---|---|
| 2,212,757 | 8/1940 | Stout | 52/174 |
| 3,452,492 | 7/1969 | Brockway | 52/174 X |
| 3,708,931 | 1/1973 | Button | 52/174 X |
| 4,075,799 | 2/1978 | Lemelson | 52/169.11 X |
| 4,125,975 | 11/1978 | Soble | 52/DIG. 11 X |

*Primary Examiner*—Carl D. Friedman

*Attorney, Agent, or Firm*—Schwartz, Jeffery, Schwaab, Mack, Blumenthal & Evans

[57] ABSTRACT

A building structure includes a building unit, such as a mobile home, house trailer, motor home, prefabricated building, hut or shed, duck blind, platform, or dock. There is also provided a shell, preferably of a resilient plastic material, which shell is of such size and configuration as to underly the building unit and provide a base upon which the building is supported. The shell defines a space between itself and the building unit. This space is substantially entirely filled with an insulating foam filling material in the shell. That is, according to the method of construction of the present invention, a dished shell with a hollow interior is placed at a selected building site in a concave, upward condition, which shell constitutes a main part of a foundation for the overall building structure. A building unit of the type described is moved into overlying relationship with respect to the hollow dished shell such that the hollowness of the shell defines a space between the shell and the building unit, which building unit constitutes that part of the building structure above the foundation. The space between the shell and building unit is then substantially entirely filled with the plastic foam material.

44 Claims, 9 Drawing Figures

FOUNDATION FOR BUILDING STRUCTURE AND METHOD OF CONSTRUCTING BUILDING STRUCTURE UTILIZING SAME

BACKGROUND OF THE INVENTION

1. Field of the Invention

The present invention relates to foundations for building units, such as prefabricated buildings, mobile homes, house trailers, and other building units, such as duck blinds, platforms, or docks. The present invention also relates to a method of constructing a building structure and specifically to constructing a foundation for building units of the foregoing types.

2. Description of the Prior Art

Building units such as mobile homes, house trailers, motor homes, prefabricated homes, and prefabricated sheds are subject to problems of energy efficiency and instability in a hostile outdoor environment. For instance, mobile homes, house trailers and motor homes are subject to energy inefficiencies as a result of their typically being disposed off the ground. That is, the floor or bottom of the unit is subjected to the elements, including extremes of temperature and heat, resulting in heat loss through the floor of the bottom of the unit.

In addition, this same space between the floor or bottom of the unit and the ground, which space is typically necessitated by the wheels, axle, suspension, etc., of the chasis of the unit, makes the unit susceptible of rolling over or otherwise being dislocated or displaced by high winds which may sweep into the area between the bottom of the unit and the ground. Also, this same problem of winds sweeping under the unit aggrevates the energy inefficiency and heat transfer problems already mentioned. Furthermore, such units are particularly susceptible to flood damage, as they may easily be dislodged, moved away, rolled over, and otherwise dislocated by flood waters which would not necessarily destroy a conventional building on a conventional foundation. Problems such as the type mentioned above are also found with respect to other building units, such as duck blinds and platforms and, to some extent, in docks.

SUMMARY OF THE INVENTION

It is therefore an object of the present invention to overcome the drawbacks of building structures of the type which include such building units as mobile homes, house trailers, motor homes, prefabricated buildings and sheds, duck blinds, platforms, and docks.

It is a further object of the present invention to overcome the drawbacks of the prior art with a foundation for such building units which is particularly simple in construction, utilizing economical materials, easy to construct, and which involves a method of construction which is particularly simple, easy and economical.

It is yet another related object of the present invention to provide a building structure with a foundation under the building unit which provides increased energy efficiency and, in the case of an enclosed structure, reduces heating and cooling costs.

It is still another related object of the present invention to provide a building structure for the type of building unit described above which eliminates an air space or dead space below the building unit so that, in the event of high winds or storms, the wind or other elements are deflected away and displacement of the building unit is avoided.

It is a further object of the present invention to provide a foundation and method of construction for a building structure of the type described above in which the building unit may be easily moved into place in overlying relationship with respect to the foundation.

It is yet another object of the present invention to provide a building structure and method of construction in which flotation may be provided in the event of flooding around the building unit.

These and other objects, advantages and features of the present invention will become more apparent from the following detailed description and accompanying drawing of certain preferred embodiments of the invention.

To achieve the advantages of the present invention, there is provided a building structure comprising a building unit, such as a mobile home, house trailer, motor home, prefabricated building, hut or shed, duck blind, platform, or dock. There is also provided a shell, preferably of a resilient plastic material, which shell is of such size and configuration as to underly the building unit and provide a base upon which the building unit is supported. The shell defines a space between itself and the building unit. This space is substantially entirely filled with an insulating foam filling material in the shell. That is, according to the method of construction of the present invention, a dished shell with a hollow interior is placed at a selected building site in a concave, upward condition, which shell constitutes a main part of a foundation for the overall building structure. A building unit of the type described is moved into overlying relationship with respect to the hollow dished shell such that the hollowness of the shell defines a space between the shell and the building unit, which building unit constitutes that part of the building structure above the foundation. The space between the shell and building unit is then substantially entirely filled with the plastic foam material.

DETAILED DESCRIPTION

Figure 1:
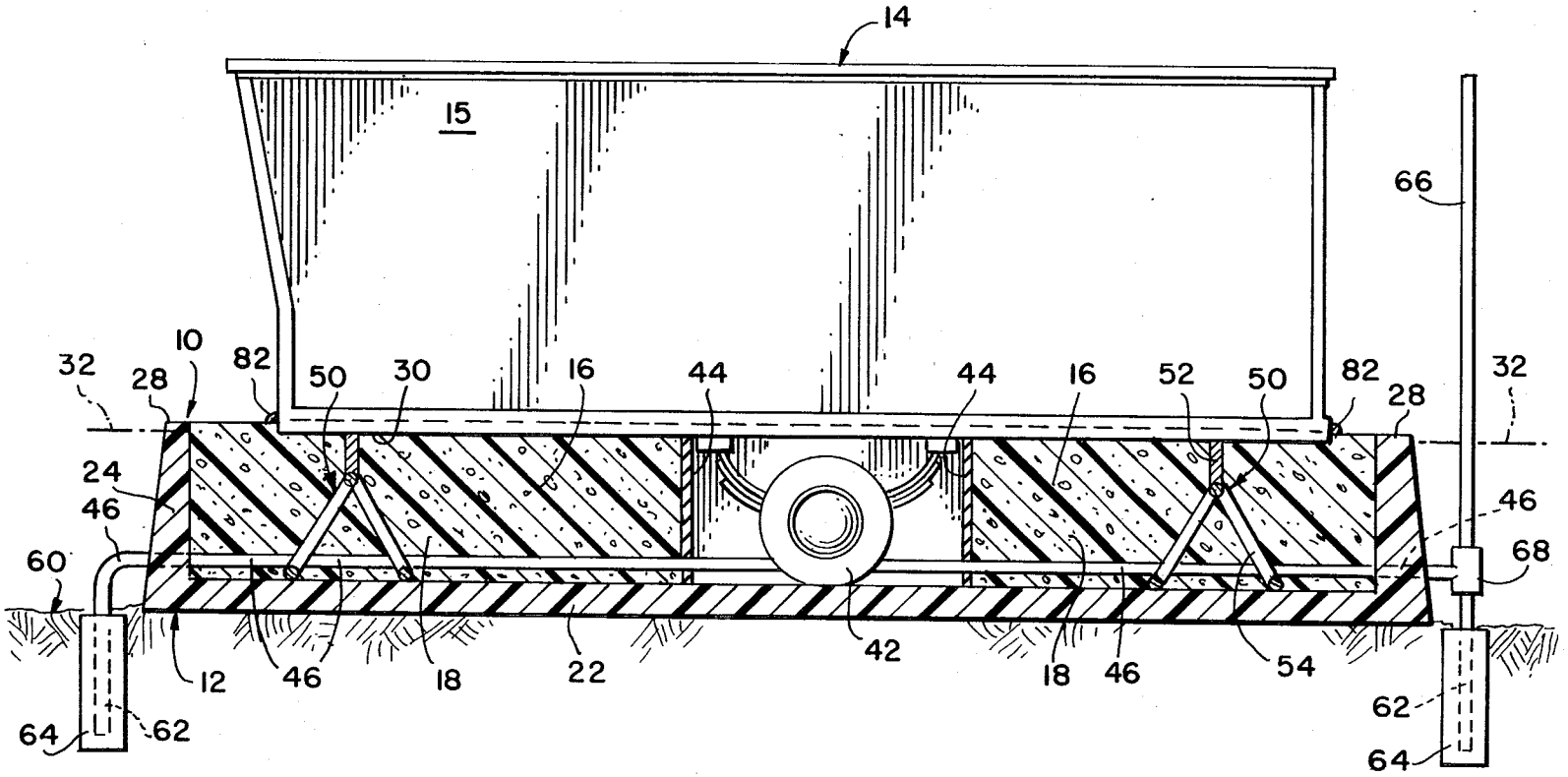
FIG. 1 is an elevational view, partly in section, of an overall building structure according to the present invention, which building structure is composed of a foundation supporting a building unit, one type of anchor for the foundation being depicted at the left of FIG. 1, and another type of anchor being depicted at the right of FIG. 1.

In the description which follows and in the drawing, like reference characters used among different figures of the drawing refer to like elements or features.

Turning first to FIG. 1, reference numeral 10 refers generally to the foundation of the present invention. A major component of foundation 10 is an outer shell 12 of a size, shape, and material suitable for a particular building unit 14 to be erected on foundation 10. For example, in the embodiment of FIG. 1, where the building unit 14 is a house trailer or mobile home 15, the outer shell may be constructed of a material such as, but not limited to, an ABS plastic material with closed cell injected foam core. The outer shell 12 should preferably be constructed of a resilient material, it should be waterproof, mold and mildew resistant, and fire retardant. Outer shell 12 is of such size and configuration as to underly the building unit 14 and to provide a base on which the building unit 14 is supported. Shell 12 defines a space 16 between itself and the building unit 14.

An insulating filling 18 is provided in shell 12, the insulating filling 18 being of such volume and shape as to substantially fill space 16 between itself and the building unit 14. Preferably, insulating filling 18 substantially fills the shell 12 and is preferably composed of a plastic foam material. In particular, insulating filling 18 is preferably an expanded, rigid polystyrene plastic foam material, such as that sold under the trademark "Styrofoam."

If the foundation 10 will be moved or relocated, the insulating filling 18 may take the form of interfitting pieces or blocks 20 of plastic foam material. These blocks may be inserted into the shell 12 beneath the building unit 14. Then, if unit 14 is to be relocated, the blocks 20 may be removed from beneath the building unit 14, and the entire building structure may be moved to its new location.

Figure 3:
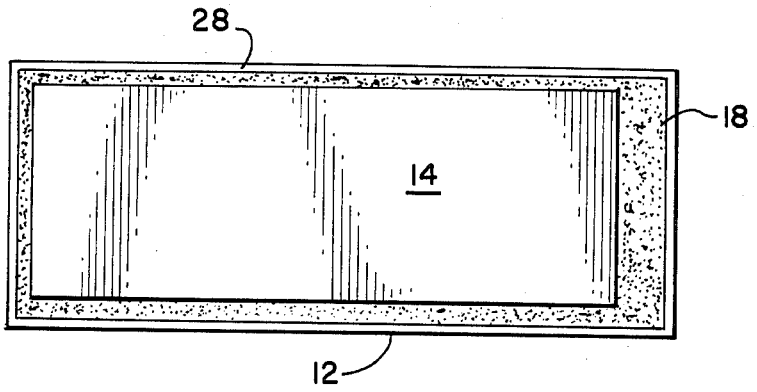
FIG. 3 is a plan view on reduced scale of the building structure of FIG. 1 absent the depiction of the anchors of FIG. 1.

Shell 12 has a profile as viewed in plan view, which profile in plan will be seen in FIG. 3. The building unit 14 also has a profile in plan view as also seen in FIG. 3. Preferably, the profile in plan of shell 12 surrounds and overlaps that of building unit 14 as shown in FIG. 3.

Figure 2:
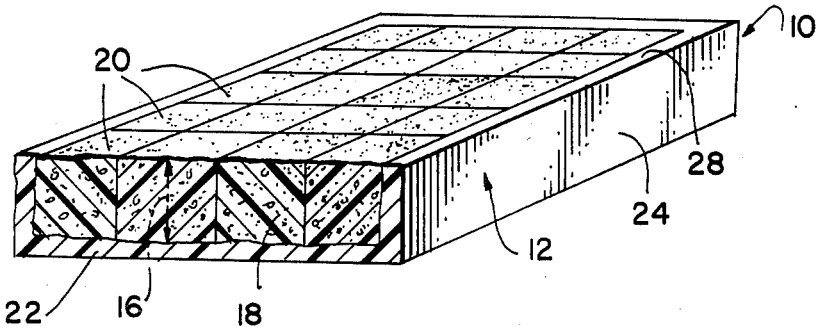
FIG. 2 is an isometric view, partly in section, of a foundation according to the present invention, which foundation includes a different type of insulating foam filling from that of FIG. 1, i.e., which foundation includes a foam filling in the form of a plurality of interfitting blocks.
Figure 4:
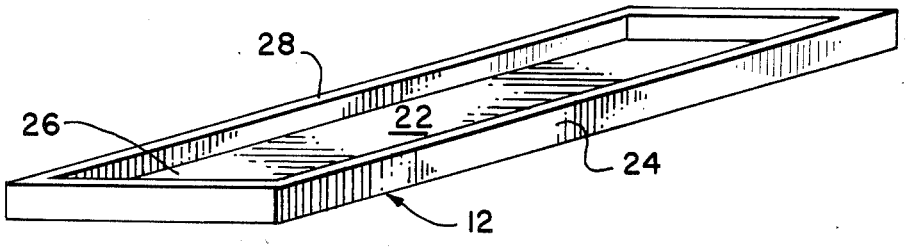
FIG. 4 is an isometric view showing the shell of the foundation of the present invention.

Shell 12 includes a bottom wall 22 from which extends upstanding side walls 24 defining a shell interior 26, as best seen in FIG. 4. The result is a dished shell with a hollow interior 26, as best seen in FIGS. 2 and 4, which shell, as already indicated, forms the main part of foundation 10 for an overall building structure 10, 14 at a selected building site. Shell 12 assumes a concave upward posture when in place at the building site. Building unit 14 is in overlying relationship with respect to the hollow dished shell 12 such that the hollowness of the shell defines space 16 between the shell 12 and building unit 14. Of course, building unit 14 constitutes that part of the overall building structure above the foundation 10. Side walls 24 include top edges 28 remote from bottom wall 22. The building unit 14 includes a bottom or floor 30 disposed at a certain level 32, shown in phantom lines in FIG. 1. Side walls 24 of shell 12 extend upwardly to a level above the level 32 of the bottom of the building unit 14, so that the building unit 14 rests within the shell and so that the side walls 24 of the shell are higher than the bottom 30 of the building unit. At the very least, side walls 24 must extend vertically at least to level 32 of the bottom 30 of the building unit 14 when the building unit is in place on the foundation 10.

As already indicated, the particular building unit 14 depicted in FIG. 1 is a house trailer or mobile home 15, i.e., a mobile unit. As such, it has wheels 42. In order to permit movement of the mobile building unit 14 onto the foundation, side walls 24, or at least a portion thereof, are resilient. In particular, side walls 24 are movable between a bent condition as shown in FIG. 5 allowing the wheels 42 of the mobile unit to pass over side walls 24 to move the mobile building unit into or out of place with respect to shell 12, and a relaxed condition as shown in FIGS. 1, 2 and 4 in which the side walls 24 have resumed their normal, upstanding positions with respect to bottom wall 22 of shell 12.

Figure 5:
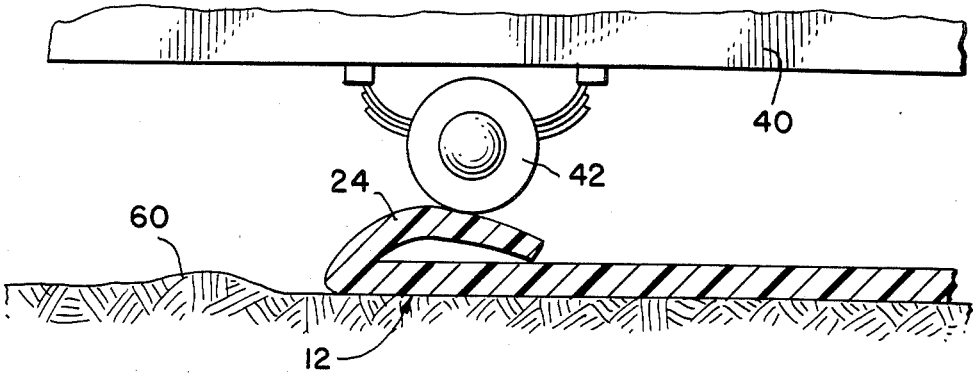
FIG. 5 is a fragmentary side elevation, partly in section, showing one of the walls of the shell of the foundation of the present invention in a bent condition during movement of the building unit into place above the foundation.

When the mobile building unit 14 has been moved into place with respect to shell 12 as a result of resilient bending of one of the side walls 24 as shown in FIG. 5, and once steps have been completed for any exterior connections for plumbing, electricity, heating and cooling, the next step is to fill the shell 12 with an appropriate foam material. But before doing so at this point, particularly if the building structure needs to have added stability due to adverse climate in the area, or needs flotation properties, a rigid framework 46 is coupled with shell 12. This rigid framework 46 preferably is constructed of tubular material, such as metal or PVC pipes. In order to adjust the building unit 14 into a level condition after it has moved into overlying relationship with respect to shell 12, the framework 46 includes a set of jacks 50 which extend upwardly from bottom wall 22 of shell 12. Each jack 50 includes a movable portion 52 and a stationary portion 54. Each jack 50 is engageable with the building unit 14 to support the building unit. Movement of the movable portion 52 of each jack 50 with respect to the stationary portion 54 thereof adjusts the position of the building unit 14 relative to the shell 12.

As previously indicated, this foam filling material may be accomplished by use of multiple, interfitting pieces or blocks 20 of foam material as shown in FIG. 2. Nevertheless, on-site production of foam filling 18 to fill the hollow shell interior 26 is also possible. In this latter instance, a barrier 44 of such size and shape as to surrond the wheels 42 is installed within the shell interior 26 to protect the wheels 42 and associated axles and suspension from becoming imbedded in the foam filling 18. With on-site production of foam filling 18, the foam is filled to the desirable level, at least to the level of the bottom 30 of the building unit 14.

To secure foundation 10 with respect to the ground 60, the framework 46 extends outside the shell 12 and includes an anchor portion 62 which extends downwardly from the level of the bottom wall 22 of shell 12 to anchor the framework 46, and thus the shell 12, with respect to the ground 60. For a structure which is not likely to encounter water and does not require flotation, this may be accomplished via an elbow joint connected to 46 as shown at the left side of FIG. 1. Each anchor portion 62 may be secured by a concrete footing 64. Thus, the structure is anchored for increased wind stability via the anchor portions 62 which is part of the overall inter-connecting rigid framework 46, most of which is within the shell.

If the overall structure 10, 14 is to have flotation capabilities, framework 46 will be made sufficiently strong to support the entire weight of the completed structure. To allow flotation, such as to accommodate periodic flooding, or to accommodate building unit 14 in the form of a dock, the anchor portion 62 of framework 46 also includes an upward extension 66 which extends substantially above the ground 60. Framework 46 also includes a coupling 68 taking the form of a sleeve which engages the upward extension 66 for movement therealong. Thus, when an upward force is exerted upon the shell 12 and insulating filling 18, say as a result of water surrounding the foundation 10, the shell 12 and filling 18 may rise together along with building unit 14 relative to anchor portion 62 by vertical movement of coupling 68 upwardly along upward extension 66. In this regard, the construction of the shell as shown and described herein, together with the natural buoyancy of the foam material of the insulating filling 18, effects flotation of building unit 14 and foundation 10. If such buoyancy is to be provided with respect to a dwelling utilizing plumbing, sewage and/or electrical connections, these will have to be extended beyond the shell 14 by appropriate combinations of flexible and rigid pipes which are readily obtainable.

As already indicated, the particular building unit 14 to be supported by foundation 10 may take many different forms. It need not be a dwelling and it need not be enclosed. In this regard, the expression "building unit" is intended to encompass such diverse constructions as mobile homes and trailers, sheds or shacks, prefabricated homes, docks, platforms, duck blinds, and many other varieties of construction units.

Figure 6A:
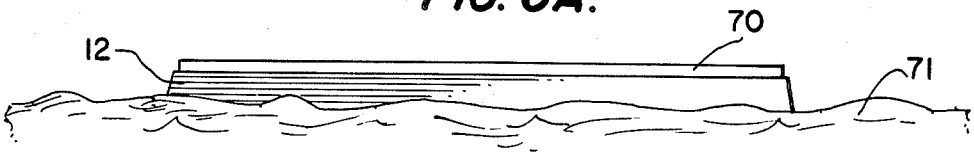
FIG. 6A is a side elevation showing another embodiment of the present invention in which the present invention is utilized in connection with a dock.
Figure 6B:
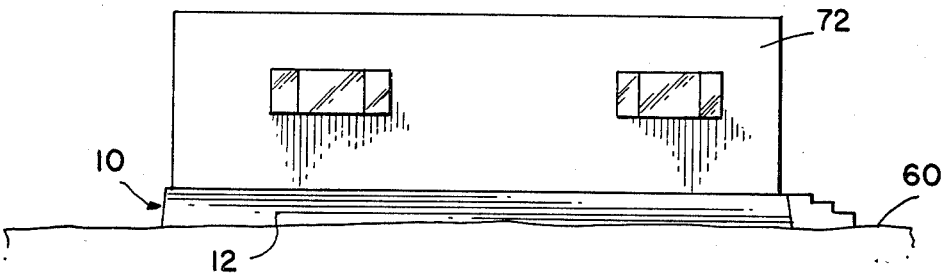
FIG. 6B is a side elevation of another embodiment of the present invention showing use of the present invention in connection with a prefabricated building, hut, or shed.
Figure 6C:
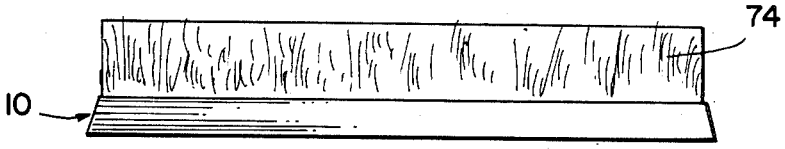
FIG. 6C is a side elevation of another embodiment of the present invention showing use of the present invention in connection with a duck blind.
Figure 6D:
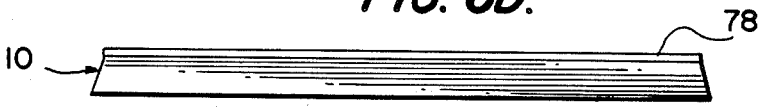
FIG. 6D is a side elevation of another embodiment of the present invention showing use of the present invention in connection with a platform.

FIG. 6A depicts a building unit in the form of a dock 70 floating on a body of water 71. The dock 70 may be kept in place by conventional anchors, or by an anchoring arrangement utilizing an upward extension 66 and coupling 68 in the form of a slideable sleeve as shown in at the right of FIG. 1 and described above. FIG. 6B shows the foundation 10 of the present invention utilized to support a prefabricated house, a shack or a shed 72 as the building element. In FIG. 6C, a duck blind 74 constitutes the building element supported by foundation 10. In FIG. 6D, foundation 10 supports a building structure in the form of a simple platform 78.

The foundation of the present invention provides improved insulation, stability and, if desirable, flotation capabilities for supporting building units of the type described. In the case of an enclosed building unit 14, once the unit has been placed within the outer shell 12 and the void space between the unit 14 and shell 12 filled with the insulating foam filling 18, transfer of heat through the bottom or floor 30 of building unit 14 is significantly reduced. This may be further enhanced by providing a bead of caulk 82 (FIG. 1) between the building unit 14 and the foundation 10, thus making the overall structure 10, 14 virtually air tight.

The present invention also provides increased stability for the overall building structure 10, 14. By eliminating any air space or dead space below the structure 10, 14, in the event of high winds or storms, the wind is deflected away, thus eliminating the possibility of wind getting under the structure to cause it to be displaced or to roll over. The use of anchors as described above will also add to this stability.

The device of the present invention may also provide flotation. Since a plastic foam material of the type used in connection with the present invention, i.e., a material such as sold under the trademark "Styrofoam," is naturally buoyant, more than adequate buoyancy will be provided by the present invention to float virtually any mobile home or other prefabricated structure presently available. The previously described construction by which the foundation 10 may be anchored and yet vertically movable, allows the overall structure 10, 14 to rise and fall with the level of the surrounding water 71.

It is thus evident that the present invention provides for increased energy efficiency, stability, flotation capability, and safety and security of any mobile or prefabricated home, portable building or shed, duck blind, dock, platform or other construction or building unit to which its use may be applied.

While the present invention has been described in connection with certain preferred embodiments, it will be understood that many additional changes, modifications, variations and different embodiments are possible without departing from the spirit and scope of the invention as defined by the claims which follow.

What is claimed is:

1. A foundation for a mobile building unit having wheels, the foundation comprising:

(a) a shell having side walls said shell being of such size and configuration as to underlie the building unit and provide a base on which the building unit is supported, said shell partially defining a space between itself and the building unit, and (b) an insulating filling in said shell, said insulating filling being of such volume and shape as to fill said space between said shell and the building unit, (c) said side walls of said shell being resiliently movable between a bent condition, allowing the wheels of the mobile building unit to pass over said side walls to move the mobile building unit into or out of place, and a relaxed condition in which said side walls have resumed their normal, upstanding position with respect to said bottom wall of said shell, (d) whereby increased energy efficiency and stability are provided for the building unit.

2. The invention as claimed in claim 1, wherein said insulating filling substantially fills said shell.

3. The invention as claimed in claim 1, wherein said insulating filling is composed of a foam material.

4. The invention as claimed in claim 1, wherein said insulating filling is composed of a set of interfitting pieces of foam material.

5. The invention as claimed in claim 3, wherein said foam material is an expanded, rigid polystyrene plastic.

6. The invention as claimed in claim 1, wherein said shell has a profile as viewed in a plan view, wherein the building unit also has a profile as viewed in plan view, said profile of said shell surrounding and overlapping that of the building unit.

7. The invention as claimed in claim 1, wherein said shell includes a bottom wall from which extends said side walls in an upstanding disposition with respect to said bottom wall, said side walls defining a shell interior.

8. The invention as claimed in claim 7, wherein said insulating filling substantially fills said shell interior.

9. The invention as claimed in claim 7, wherein said side walls include top edges remote from said bottom wall and wherein the building unit includes a bottom, said side walls extending vertically at least to the level of the bottom of the building unit when the building unit is in place on the foundation.

10. The invention as claimed in claim 1, including a barrier in said shell interior, said barrier being of such size and shape as to surround the wheels of the mobile building unit.

11. The invention as claimed in claim 1, including a rigid framework coupled with said shell, said rigid framework being for supporting the building unit in overlying relationship with respect to said shell.

12. The invention as claimed in claim 11, wherein said rigid framework includes a jack which extends upwardly from said bottom wall of said shell, said jack including a movable portion and a stationary portion, whereby said jack is engageable with the building unit to support the building unit and whereby movement of the movable portion of the jack with respect to said stationary portion thereof adjusts the position of the building unit relative to said shell.

13. The invention as claimed in claim 11, wherein said shell is for disposition on the ground and wherein said framework includes an anchor portion which extends downwardly from the level of said bottom wall of said shell to anchor said framework and said shell with respect to the ground.

14. The invention as claimed in claim 13, wherein said anchor portion of said framework also includes an upward extension which extends substantially above the ground and wherein said framework also includes a coupling which engages said upward extension for movement therealong, whereby, when an upward force is exerted upon said shell and said insulating filling, they may rise, along with the building unit, relative to said anchor portion by vertical movement of said coupling upwardly along said upward extension.

15. The invention as claimed in claim 11, including means for effecting flotation of said building unit, said flotation means being provided by said shell and by said insulating filling being of a buoyant material.

16. A building structure comprising:

(a) a mobile building unit having wheels, (b) a shell having side walls said shell being of such size and configuration as to underlie said building unit and provide a base on which said building unit is supported, said shell partially defining a space between itself and said building unit, and (c) an insulating filling in said shell, said insulating filling being of such volume and shape as to fill said space between said shell and said building unit, (d) said shell and insulating filling providing a foundation for said building element, (e) said side walls of said shell being resiliently movable between a bent condition, allowing the wheels of the mobile building unit to pass over said side walls to move the mobile building unit into or out of place, and a relaxed condition in which said side walls have resumed their normal, upstanding position with respect to said bottom wall of said shell, (f) whereby increased energy efficiency and stability are provided for said building unit.

17. The invention as claimed in claim 16, including a joint between said insulating filling and said building element, and including a seal at said joint.

18. The invention as claimed in claim 17, wherein said seal is a bead of caulk.

19. The invention as claimed in claim 16, wherein said insulating filling substantially fills said shell.

20. The invention as claimed in claim 16, wherein said insulating filling is composed of a foam material.

21. The invention as claimed in claim 20, wherein said foam material is an expanded, rigid polystyrene plastic.

22. The invention as claimed in claim 16, wherein said insulating filling is composed of a set of interfitting pieces of foam material.

23. The invention as claimed in claim 16, wherein said shell has a profile as viewed in a plan view, wherein said building unit also has a profile as viewed in plan view, said profile of said shell surrounding and overlapping that of said building unit.

24. The invention as claimed in claim 16, where1n said shell includes a bottom wall from which extends said side walls in an upstanding disposition with respect to said bottom wall, said side walls defining a shell interior.

25. The invention as claimed in claim 24, wherein said insulating filling substantially fills said shell interior.

26. The invention as claimed in claim 24, wherein said side walls include top edges remote from said bottom wall and wherein said building unit includes a bottom, said side walls extending vertically at least to the level of said bottom of said building unit when said building unit is in place on the foundation.

27. The invention as claimed in claim 16, including a barrier in said shell interior, said barrier being of such size and shape as to surround said wheels of said mobile building unit.

28. The invention as claimed in claim 16, including a rigid framework coupled with said shell, said rigid framework being for supporting said building unit in overlying relationship with respect to said shell.

29. The invention as claimed in claim 28, wherein said rigid framework includes a jack which extends upwardly from said bottom wall of said shell, said jack including a movable portion and a stationary portion, whereby said jack is engageable with said building unit to support said building unit and whereby movement of the movable portion of the jack with respect to said stationary portion thereof adjusts the position of said building unit relative to said shell.

30. The invention as claimed in claim 28, wherein said shell is for disposition on the ground and wherein said framework includes an anchor portion which extends downwardly from the level of said bottom side of said shell to anchor said framework and said shell with respect to the ground.

31. The invention as claimed in claim 30, wherein said anchor portion of said framework also includes an upward extension which extends substantially above the ground and wherein said framework also includes a coupling which engages said upward extension for movement therealong, whereby, when an upward force is extended upon said shell and said insulating filling, they may rise, along with the building structure, relative to said anchor by vertical movement of said coupling upwardly along said upward extension.

32. The invention as claimed in claim 28, including means for effecting flotation of said building element, said flotation means being provided by said shell and by said insulating filling being of a buoyant material.

33. The invention as claimed in claim 16, wherein said building element is a mobile home.

34. The invention as claimed in claim 16, wherein said building element is a house trailer.

35. A foundation for a mobile building unit having wheels, the foundation comprising:

(a) a shell having side walls said shell being of such size and configuration as to underlie the building unit and provide a base on which the building unit is supported, said shell partially defining a sppce between itself and the building unit, and (b) an insulating filling in said shell, said insulating filling being of such volume and shape as to fill said space between said shell and the building unit, (c) at least one of said side walls of said shell being resiliently movable between a bent condition, allowing the wheels of the mobile building unit to pass over said movable side wall to move the mobile building unit into or out of place, and a relaxed condition in which said movable side wall has resumed its normal, upstanding position with respect to said bottom wall of said shell, (d) whereby increased energy efficiency and stability are provided for the building unit.

36. A building structure comprising:

(a) a mobile building unit having wheels, (b) a she11 having side walls said shell being of such size and configuration as to underlie said building unit and provide a base on which said building unit is supported, said shell partially defining a space between itself and said building unit, and (c) an insulating filling in said shell, said insulating filling being of such volume and shape as to fill said space between said shell and said building unit, (d) said shell and insulating filling providing a foundation for said building element, (e) at least one of said side walls of said shells being resiliently movable between a bent condition, allowing the wheels of the mobile building unit to pass over said movable side wall to move the mobile building unit into or out of place, and a relaxed condition in which said movable side wall has resumed its normal, upstanding position with respect to said bottom wall of said shell, (f) whereby increased energy dfficiency and stability are provided for said building unit.

37. The invention as claimed in claim 36, including means for effecting flotation of said building unit, said flotation means being provided by said shell and by said insulating filling being of a buoyant material.

38. A foundation for a building unit, the foundation comprising:

(a) a shell, said shell being of such size and configuration as to underlie the building unit and provide a base on which the building unit is supported, said shell partially defining a space between itself and the building unit, and (b) an insulating filling in said shell, said insulating filling being of such volume and shape as to fill said space between said shell and the building unit, (c) a rigid framework coupled with said shell, said rigid framework being for supporting the building unit in overlying relationship with respect to said shell, (d) said shell being for disposition with respect to the ground and wherein said framework includes an anchor portion which extends downwardly from the level of said bottom wall of said shell to anchor said framework and said shell with respect to the ground, (e) said anchor portion of said framework also includes an upward extension which extends substantially above the ground and wherein said framework also includes a coupling which engages said upward extension for movement therealong, whereby, when an upward force is exerted upon said shell and said insulating filling, they may rise, along with the building unit, relative to said anchor portion by vertical movement of said coupling upwardly along said upward extension, and (f) whereby increased energy efficinecy and stability are provided for the building unit.

39. A building structure comprising:

(a) a building unit, (b) a shell, said shell being of such size and configuration as to underlie said building unit and provide a base on which said building unit is supported, said shell partially defining a space between itself and said building unit, and (c) an insulating filling in said shell, said insulating filling being of such volume and shppe as to fill said space between said shell and said building unit, (d) said shell and insulating filling providing a foundation for said building element, (e) a rigid framework coupled with said shell, said rigid framework being for supporting the bulding unit in overlying relationship with respect to said shell, (f) said shell being for disposition with respect to the ground and wherein said framework includes an anchor portion which extends downwardly from the level of said bottom wall of said shell to anchor said framework and said shell with respect to the ground, (g) said anchor portion of said framework also includes an upward extension which extends substantially above the ground and wherein said framework also includes a coupling which engages said upward extension for movement therealong, whereby, when an upward force is exerted upon said shell and said insulating filling, they may rise, along with the building unit, relative to said anchor portion by vertical movement of said coupling upwardly along said upward extension, and (h) whereby increased energy efficiency and stability are provided for the building unit.

40. The invention as claimed in claim 39, wherein said building element is a prefabricated house.

41. The invention as claimed in claim 39, wherein said building element is a dock.

42. The invention as claimed in claim 39, wherein said building element is a platform.

43. The invention as claimed in claim 39 wherein said building element is a Duck Blind.

44. The invention as claimed in claim 39, including means for effecting flotation of said building unit, said flotation means being provided by said shell and by said insulating filling being of a buoyant material.

* * * * *